US008826656B2

(12) United States Patent
Ueda et al.

(10) Patent No.: US 8,826,656 B2
(45) Date of Patent: Sep. 9, 2014

(54) SLEWING TYPE WORKING MACHINE

(75) Inventors: Koji Ueda, Hiroshima (JP); Koji Yamashita, Hiroshima (JP); Masayuki Komiyama, Hiroshima (JP); Yoichiro Yamazaki, Hiroshima (JP); Yusuke Kamimura, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 14/007,978

(22) PCT Filed: Apr. 19, 2012

(86) PCT No.: PCT/JP2012/002724

§ 371 (c)(1),
(2), (4) Date: Sep. 27, 2013

(87) PCT Pub. No.: WO2012/150653

PCT Pub. Date: Nov. 8, 2012

(65) Prior Publication Data

US 2014/0013753 A1 Jan. 16, 2014

(30) Foreign Application Priority Data

| | | |
|---|---|---|
| May 2, 2011 | (JP) | 2011-103058 |
| May 11, 2011 | (JP) | 2011-106184 |
| May 16, 2011 | (JP) | 2011-109742 |
| Jun. 1, 2011 | (JP) | 2011-123307 |

(51) Int. Cl.

| | |
|---|---|
| ***E02F 9/12*** | (2006.01) |
| ***E02F 9/20*** | (2006.01) |
| ***E02F 9/22*** | (2006.01) |
| *F15B 21/14* | (2006.01) |

(52) U.S. Cl.

CPC ..... *E02F 9/123* (2013.01); *F15B 2211/6336* (2013.01); *F15B 2211/7058* (2013.01); *F15B 2211/6313* (2013.01); *F15B 2211/6316* (2013.01); *F15B 2211/3116* (2013.01); *F15B 2211/88* (2013.01); *F15B 21/14* (2013.01); *E02F 9/2095* (2013.01); *E02F 9/2091* (2013.01); *E02F 9/2217* (2013.01); *F15B 2211/50527* (2013.01)

USPC ..... 60/414; 60/468

(58) Field of Classification Search

CPC ..... E02F 9/12; E02F 9/123
USPC ..... 60/414, 466, 468
See application file for complete search history.

(56) References Cited

U.S. PATENT DOCUMENTS

| | | | | |
|---|---|---|---|---|
| 6,732,513 | B2 * | 5/2004 | Tajima | 60/468 |
| 6,761,029 | B2 | 7/2004 | Linerode | |

(Continued)

FOREIGN PATENT DOCUMENTS

| | | |
|---|---|---|
| JP | 8 200305 | 8/1996 |
| JP | 2005 344431 | 12/2005 |

(Continued)

OTHER PUBLICATIONS

International Search Report Issued Jul. 31, 2012 in PCT/JP12/002724 filed Apr. 19, 2012.

(Continued)

*Primary Examiner* — F. Daniel Lopez
(74) *Attorney, Agent, or Firm* — Oblon, Spivak, McClelland, Maier & Neustadt, L.L.P.

(57) ABSTRACT

A slewing-type working machine includes: a hydraulic motor having first and second ports and driving an upper slewing body to slew it; a hydraulic pump; a slewing operating device including an operating member; a control valve controlling the hydraulic motor based on an operation signal of the slewing operating device; first and second pipe-lines connecting the first and second ports of the hydraulic motor to the control valve; communication switching devices switchable between communication and cutoff between both pipe-lines and a tank; a slewing electric motor; an electric storage device; and a controller. During a slewing operation, the controller brings the communication switching devices into a communicated state and performs regenerative control by issuing a command on a regeneration amount corresponding to a reduction in back pressure by the communication switching devices in the communicated state to the slewing electric motor.

5 Claims, 5 Drawing Sheets

(56) References Cited

U.S. PATENT DOCUMENTS

| | | | | |
|---|---|---|---|---|
| 7,066,446 | B2 | 6/2006 | Nielsen | |
| 2010/0263364 | A1 | 10/2010 | Tsutsui et al. | |
| 2013/0213026 | A1 * | 8/2013 | Yamamoto et al. | 60/327 |

FOREIGN PATENT DOCUMENTS

| | | |
|---|---|---|
| JP | 2008-063888 | 3/2008 |
| JP | 2010 65510 | 3/2010 |
| JP | 2012 127123 | 7/2012 |
| WO | 2012/035735 | 3/2012 |

OTHER PUBLICATIONS

Japanese Office Action Issued Jul. 24, 2012 in JP Patent Application No. 2011-103058 filed May 2, 2011(with English translation).

* cited by examiner

SLEWING TYPE WORKING MACHINE

TECHNICAL FIELD

The present invention relates to a slewing-type working machine such as an excavator.

BACKGROUND ART

The background art of the present invention will be described using an excavator as an example.

For example, as shown in FIG. 5, a general excavator comprises a crawler-type base carrier 1, an upper slewing body 2 mounted on the base carrier 1 so as to be slewed around an axis X that is perpendicular to the ground, and an excavating attachment 3 attached to the upper slewing body 2. The excavating attachment 3 includes a boom 4 capable of being raised and lowered, an arm 5 attached to a tip of the boom 4, a bucket 6 attached to a tip of the arm 5, and a plurality of cylinders (hydraulic cylinders) for actuating the boom 4, the arm 5, and the bucket 6, respectively, namely: a boom cylinder 7, an arm cylinder 8, and a bucket cylinder 9.

Japanese Patent Application Laid-open No. 2010-65510 (Patent Document 1) discloses an excavator such as that described above, the excavator comprising: a hydraulic motor for slewing an upper slewing body; a slewing electric motor connected to the hydraulic motor; a direct-communication selector valve capable of bringing respective pipe-lines on both sides of the motor connected to a pair of ports of the hydraulic motor, respectively, into direct communication with each other; and an electric storage device, wherein the direct-communication selector valve, during deceleration of the rotation, returns hydraulic fluid discharged from the motor to a inlet side of the motor and the slewing electric motor performs a generator action to produce regenerative power, the electric storage device storing the regenerative power. With this technique, the direct-communication selector valve lowers back pressure acting on a motor outlet side during rotation deceleration to reduce drag load on the hydraulic motor, thereby enabling efficiency of recovery (that is, regeneration) of inertial kinetic energy to be improved. There is provided a hydraulic brake device including a pair of relief valves between the pipe-lines on both sides of the motor; however, the hydraulic brake device is not operated during rotation deceleration but only performs a stop holding function immediately after slewing is stopped.

This technique, though improving regeneration efficiency during rotation deceleration, has a problem that regeneration efficiency of slewing energy is still insufficient because no regenerative action is produced in a driving for slewing, that is, in acceleration including start-up or in a steady operation. In addition, the direct-communication selector valve, which is set at an open position during driving for slewing and switched to a direct-communication position during regeneration, i.e., during deceleration, has a further problem of causing a large fluctuation in pressure at the moment of being switched to thereby deteriorate operability.

Patent Document 1: Japanese Patent Application Laid-open No. 2010-65510

SUMMARY OF THE INVENTION

An object of the present invention is to provide a slewing-type working machine capable of performing a regenerative action not only during slewing deceleration but also during drive for slewing to improve regeneration efficiency of slewing energy and further capable of obviating large pressure fluctuations to improve operability. The slewing-type working machine provided by the present invention includes: a base carrier; an upper slewing body mounted on the base carrier so as to be capable of being slewed; a hydraulic motor which includes first and second ports and receives supply of hydraulic fluid through one of the first and second ports and discharges the hydraulic fluid through the other one of the first and second ports, thereby driving the upper slewing body to slew it; a hydraulic pump which discharges the hydraulic fluid to be supplied to the hydraulic motor; a slewing electric motor which is rotationally driven by the hydraulic motor; an electricity storage device storing regenerative power by the slewing electric motor; a slewing operating device including an operating member to which an operation is applied to input a command for the driving to slew, the slewing operating device being adapted to output an operation signal corresponding to the operation applied to the operating member; a control valve which is operated based on the operation signal of the slewing operating device so as to control supply of hydraulic fluid to the hydraulic motor and control discharge of hydraulic fluid from the hydraulic motor; a first pipe-line connecting the first port of the hydraulic motor to the control valve; a second pipe-line connecting the second port of the hydraulic motor to the control valve; a communication switching device switchable between a communication state of bringing a pipe-line on an outlet side of the hydraulic motor of the first and second pipe-lines into communication with a tank or a pipe-line on an inlet side of the hydraulic motor of the first and second pipe-lines while bypassing the control valve and a communication cutoff state of cutting off the communication; an operation detector which detects the operation applied to the operating member of the slewing operating device; and a controller which controls a regenerative operation of the slewing electric motor and switching of the communication switching device, based on the detection signal from the operation detector. During a slewing operation of the upper slewing body, the controller switches the communication switching device to the communicated state and performs regenerative control by issuing a command to the slewing electric motor on a regenerative amount corresponding to a reduction in back pressure by the communication switching device.

EMBODIMENT FOR CARRYING OUT THE INVENTION

There will be described first and second embodiments of the present invention, with reference to FIG. 1 to FIG. 4. Each of these embodiments is applied to the excavator shown in FIG. 5 similarly to the background art described earlier.

Figure 1:
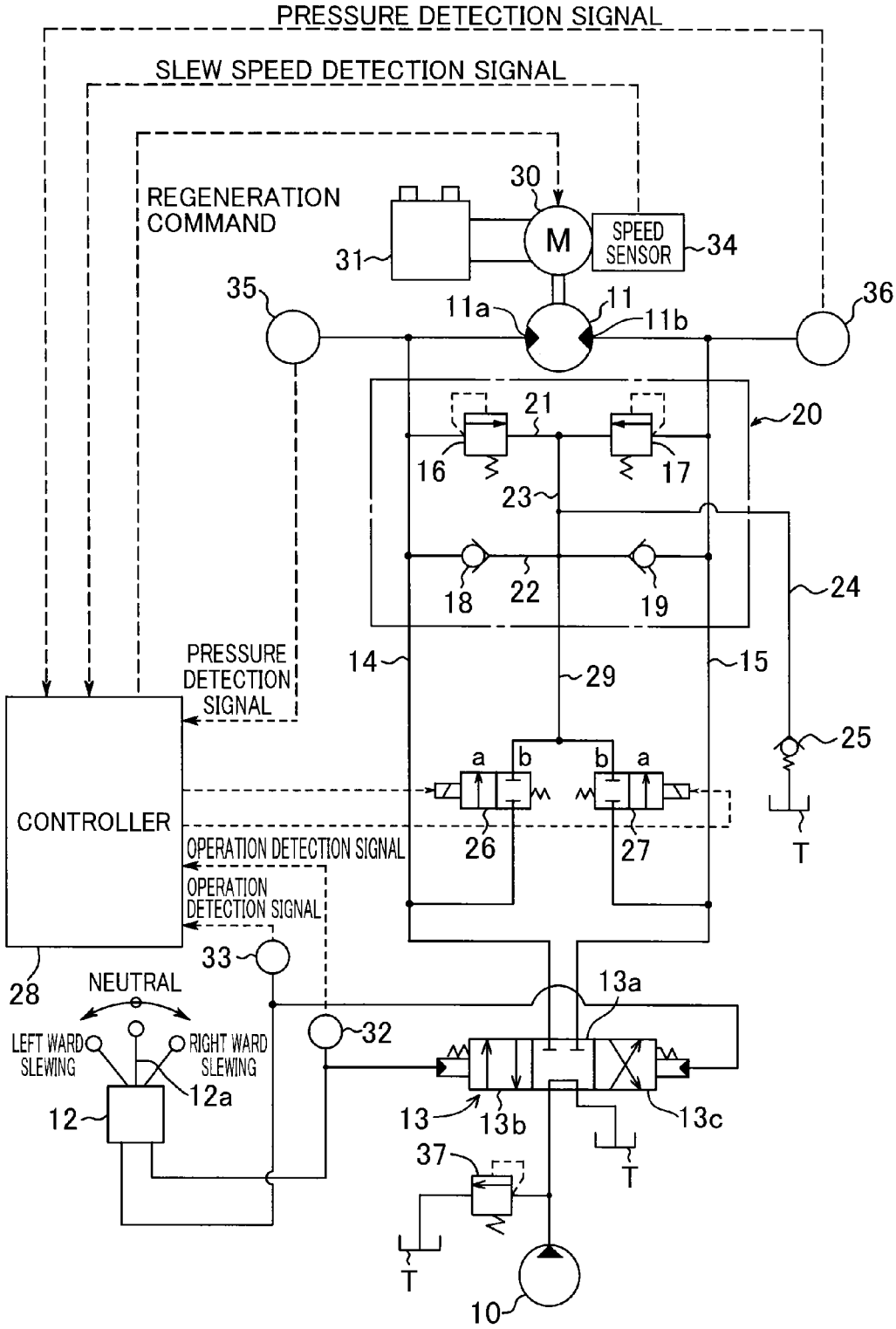
FIG. 1 is a diagram showing a hydraulic circuit according to a first embodiment of the present invention.

FIG. 1 shows a hydraulic circuit according to the first embodiment. The circuit includes a hydraulic pump 10 as a hydraulic source that is driven by an engine not graphically shown, a slewing hydraulic motor 11 which is rotated by supply of hydraulic fluid discharged from the hydraulic pump 10 to drive the upper slewing body 2 to slew it, a remote-control valve 12 as a slewing operating device including a lever 12*a* to which an operation is applied to input a slewing drive command, and a control valve 13 which is a hydraulic pilot-controlled selector valve capable of being operated by the remote-control valve 12 and provided between a pair of the hydraulic pump 10 and a tank T, and the hydraulic motor 11.

The hydraulic motor 11 includes a left port 11*a* and a right port 11*b* which are respective first and second ports. When supplied with hydraulic fluid through the left port 11*a*, the hydraulic motor 11 discharges the hydraulic fluid through the right port 11*b* to leftward slew the upper slewing body 2 shown in FIG. 5; conversely, when supplied with hydraulic fluid through the right port 11*b*, the hydraulic motor 11 discharges the hydraulic fluid through the left port 11*a* to rightward slew the upper slewing body 2.

The lever 12*a* of the remote-control valve 12 is operated between a neutral position and left and right slewing positions, and the remote-control valve 12 is adapted to output pilot pressure with a magnitude corresponding to an operation amount of the lever 12*a* from a port corresponding to an operation direction of the lever 12*a*. By the pilot pressure, the control valve 13 is switched from a graphically shown neutral position 13*a* to a left slewing position 13*b* or a right slewing position 13*c*, thereby controlling a supply direction of hydraulic fluid to the hydraulic motor 11, left and right discharge directions of hydraulic fluid from the hydraulic motor 11, and a flow rate of the hydraulic fluid. In other words, performed are: a switching of slewing states, namely, switching to respective states of acceleration (including start-up), steady operation at a constant velocity, deceleration, and stop; and control of slewing direction and slew speed.

The circuit includes a left slewing pipe-line 14 and a right slewing pipe-line 15 which are respective first and second pipe-lines, a hydraulic brake device 20, a communicating path 23, and a makeup line 24.

The left slewing pipe-line 14 connects the control valve 13 to the left port 11*a* of the hydraulic motor 11, and the right slewing pipe-line 15 connects the control valve 13 to the right port 11*b* of the hydraulic motor 11. The relief valve circuit 21, the check valve circuit 22, and the communicating path 23 are provided between the slewing pipe-lines 14 and 15.

The hydraulic brake device 20 includes a relief valve circuit 21 and a check valve circuit 22. The relief valve circuit 21 is provided so as to interconnect the slewing pipe-lines 14 and 15, including a pair of relief valves 16 and 17 having respective outlets opposed and connected to each other. The check valve circuit 22 is provided parallel to the relief valve circuit 21 so as to interconnect the slewing pipe-lines 14 and 15, including a pair of check valves 18 and 19 having respective inlets opposed and connected to each other.

The communicating path 23 connects a first portion of the relief valve circuit 21, the first portion located between the relief valves 16 and 17, to a second portion of the check valve circuit 22, the second portion located between the check valves 18 and 19. The makeup line 24 connects the communicating path 23 to the tank T in order to suck up hydraulic fluid. The makeup line 24 is provided with a back pressure valve 25.

In this apparatus, when the remote-control valve 12 is not operated, that is, when the lever 12*a* thereof is at a neutral position, the control valve 13 is kept at the neutral position 13*a* shown in FIG. 1. Upon an operation applied to the lever 12*a* from this state, the control valve 13 is operated from the neutral position 13*a* to a left-side position in the diagram (a left slewing position) 13*b* or a right-side position in the diagram (a right slewing position) 13*c* by a stroke corresponding to an amount of the operation applied to the lever 12*a*.

At the neutral position 13*a*, the control valve 13 blocks both of the slewing pipe-lines 14 and 15 from the pump 10 to prevent the hydraulic motor from rotation. Upon an operation applied to the lever 12*a* of the remote-control valve 12 toward a leftward or rightward slewing side from the state, the control valve 13 is switched to the left slewing position 13*b* or the right slewing position 13*c* to permit hydraulic fluid to be supplied to the left slewing pipe-line 14 or the right slewing pipe-line 15 from the hydraulic pump 10. This generates a state where the hydraulic motor 11 is rightward or leftward rotated to drive the slewing body 2 to slew it, that is, an acceleration state or a steady operation state. At this point in time, the hydraulic fluid discharged from the hydraulic motor 11 is returned to the tank T via the control valve 13.

For example, upon a deceleration operation applied to the remote-control valve 12 during rightward slewing drive, in other words, upon return of the lever 12*a* of the remote-control valve 12 to the neutral position or upon an operation applied to the lever 12*a* in a direction for returning it to the neutral position, supply of hydraulic fluid to the hydraulic motor 11 and return of hydraulic fluid from the hydraulic motor 11 to the tank T are stopped or respective flow rates of the supplied hydraulic fluid and returned hydraulic fluid are reduced. Meanwhile, the hydraulic motor 11 continues the rotation rightward due to the inertia of the upper slewing body 2, which raises a pressure in the left slewing pipe-line 14 on a meter-out-side of the hydraulic motor 11. When the raised pressure reaches a certain value, the relief valve 16 on the left side of the diagram is opened to activate the hydraulic brake device 20, which decelerates and stops the slewing of the upper slewing body 2. Specifically, hydraulic fluid in the left slewing pipe-line 14 sequentially passes through the relief valve 16, the communicating path 23, the check valve 19 on the right side of the diagram, and the right slewing pipe-line (a meter-in side pipe-line) 15 to flow into the hydraulic motor 11. This causes the hydraulic motor 11 in inertial rotation to receive hydraulic brake force due to the relief action to be decelerated and stopped. Decelerating and stopping the leftward slewing are similarly performed. Besides, when the slewing pipe-line 14 or 15 is subjected to negative pressure during the deceleration, the hydraulic fluid in the tank T is sucked up into the slewing pipe-line 14 or 15 in the course of the make-up line 24, the communication path 23 and the check valve circuit 22 in this order, thereby preventing cavitation.

The circuit according to the embodiment further includes: a left communication valve 26 and a right communication valve 27 which are respective first communication valve and second communication valve constituting the communication switching device; a controller 28; a slewing electric motor 30 capable of being rotationally driven by the hydraulic motor 11; an electric storage device 31; pressure sensors 32 and 33 which are respective operation detectors, a speed sensor 34 which is a speed detector, pressure sensors 35 and 36, and a relief valve 37.

Each of the communication valves 26 and 27 comprises a solenoid selector valve, adapted to be switched between an open position "a" and a closed position "b" by command signals inputted from the controller 28. The communication valves 26 and 27 include respective inlet-side ports connected to the slewing pipe-lines 14 and 15, respectively, and respective outlet-side ports connected via a passage 29 to a part of the relief valve circuit 21, the part located between the relief valves 16 and 17. Since the part of the relief valve circuit 21 is connected to the tank T via the communicating path 23 and the makeup line 24 as described earlier, the communication valves 26 and 27, when set to the open position "a", bring the slewing pipe-lines 14 and 15 into direct communication with the tank T, respectively, while bypassing the control valve 13.

The pressure sensors 32 and 33 detect respective operations applied to the remote-control valve 12 through respective pilot pressures outputted from the remote-control valve 12. In other words, the pressure sensors 32 and 33 detect whether the lever 12*a* is at the neutral position or subject to an operation for leftward or rightward slewing. Specifically, the pressure sensors 32 and 33 output respective operation detection signals corresponding to respective pilot pressures outputted from the remote-control valve 12. The speed sensor 34 detects a rotational speed of the slewing electric motor 30, i.e., the speed corresponding to a slew speed of the upper slewing body 2, and outputs a slew speed detection signal. The pressure sensors 35 and 36 detect respective pressures at the ports 11*a* and 11*b* of the hydraulic motor 11, that is, the pressure corresponding to the motor outlet-side pressure during a slewing operation, and output a pressure detection signal.

The controller 28 judges whether the upper slewing body 2 is being driven to be slewed (in acceleration including start-up or in a steady operation), or decelerated, or stopped, based on the operation detection signal inputted from the pressure sensors 32 and 33, the slew speed detection signal inputted from the speed sensor 34, and the pressure detection signal inputted from the pressure sensors 35 and 36. When the upper slewing body 2 is slewed, specifically, in a slewing operation including all of the slewing acceleration including start-up, a steady operation, and slewing deceleration, the controller 28 switches only one of the communication valves 26 and 27 to the open position "a", wherein the communication valve to be switched is opposite one to the operated communication valve, in other words, the communication valve connected to a pipe-line corresponding to an outlet-side pipe-line, of the slewing pipe-lines 14 and 15, into which hydraulic fluid from the hydraulic motor 11 is discharged (during a rightward slewing, the communication valve to be switched is the left communication valve 26 connected to the left slewing pipe-line 14, and, during a leftward slewing, the communication valve to be switched is the left communication valve 27 connected to the right slewing pipe-line 15: hereinafter referred to as an "outlet-side communication valve").

Hence, hydraulic fluid discharged during slewing drive from the hydraulic motor 11 into the left slewing pipe-line 14 or the right slewing pipe-line 15 is directly returned to the tank T through the communication valve 26 or 27 connected to the outlet-side pipe path while bypassing the control valve 13. For example, during a rightward slewing, hydraulic fluid discharged from the hydraulic motor 11 sequentially passes through the left slewing pipe-line 14, the left communication valve 26, the passage 29, the communicating path 23, and the makeup line 24 to be returned to the tank T. This returned hydraulic fluid is thus not subjected to a throttle action of the control valve 13. This makes it possible to reduce back pressure acting on the meter-out-side during slewing drive and reduce meter-in-side pressure to lower the pump pressure, thus enabling power loss of the hydraulic pump 10 to be suppressed.

During the slewing operation, the slewing electric motor 30 is rotated so as to be involved by the hydraulic motor 11. In other words, the slewing electric motor 30 is driven by the hydraulic motor 11. Meanwhile, the slewing electric motor 30 performs a generator (regenerative) action based on a regeneration command from the controller 28, thereby charging the electric storage device 31 during the slewing operation and, during deceleration, braking the hydraulic motor 11 with regenerative brake to decelerate and stop the upper slewing body 2. In the slewing stopped state, the communication valves 26 and 27 are switched to the closed position "b" by the command signal from the controller 28, and the hydraulic motor 11 and the upper slewing body 2 are held in a stopped state by the braking action of the hydraulic brake device 20.

Figure 2:
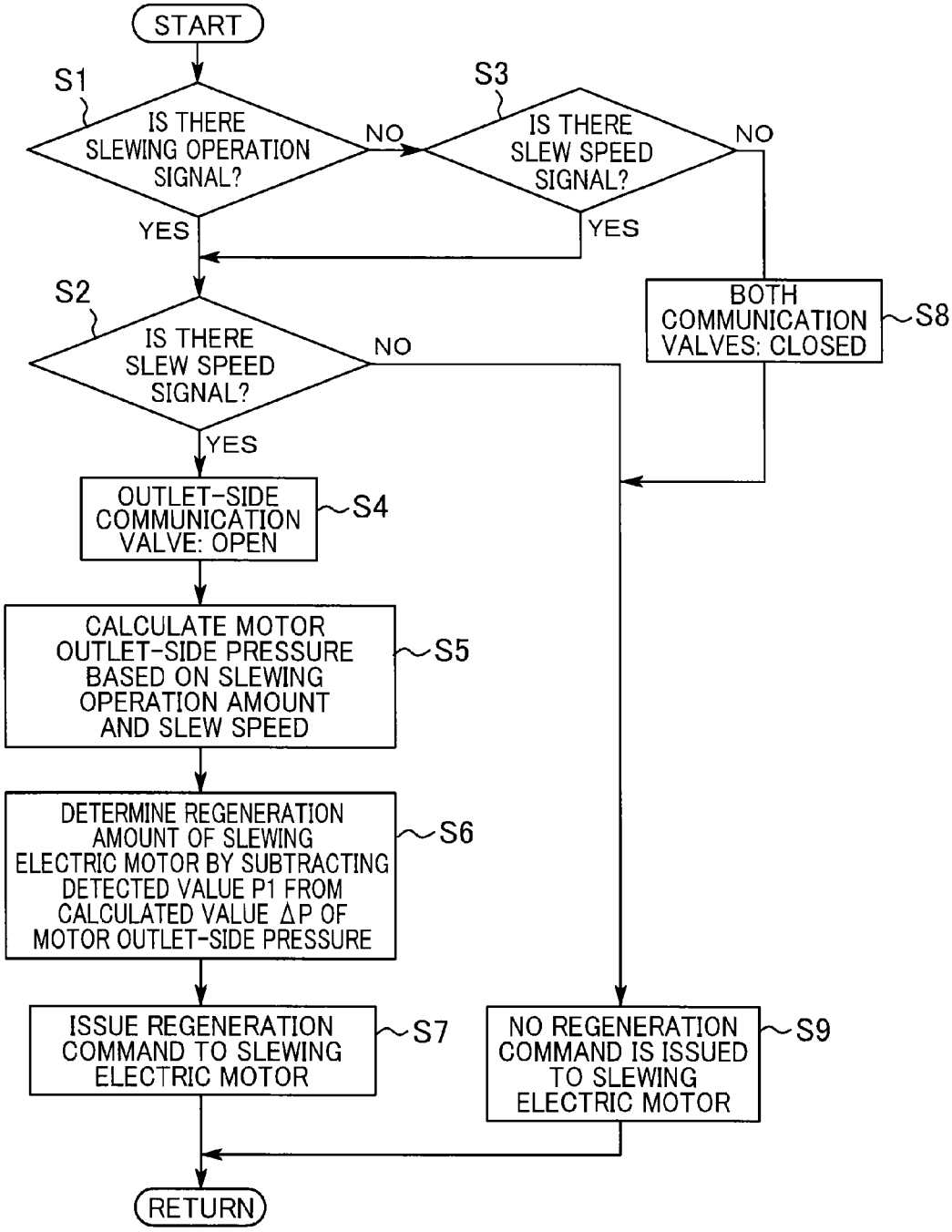
FIG. 2 is a flow chart showing a control operation of a controller according to the first embodiment.
Figure 3:
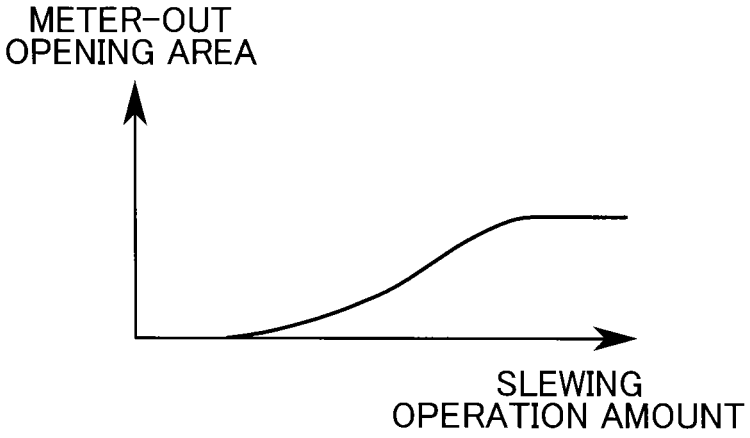
FIG. 3 is a diagram showing a relationship between slewing operation amount and control valve meter-out opening area in a conventional slewing drive system lacking in a communication switching device.

Next will be described specific control operations performed by the controller 28 according to the first embodiment, with reference to the flow chart shown in FIG. 2.

First, in step S1, the controller 28 judges a presence or absence of a slewing operation signal, that is, a presence or absence of an operation for slewing. In the case of YES, the controller 28, in step S2, judges a presence or absence of a slew speed signal, that is, whether or not slewing is being performed. In the case of NO in step S1, that is, in the case of judging that no slewing operation is applied, the controller 28 judges a presence or absence of a slew speed signal in step S3; in the case of YES in step S3, the controller 28, asserting that the remote-control valve 12 has been subject to an operation for returning to the neutral position while the upper slewing body 2 is still slewed due to inertia, repeats S2. In step S2, the controller 28 judges a presence or absence of a slew speed signal, and, in the case of YES, causes the opposite-side communication valve 26 or 27 to be opened in step S4.

In subsequent steps S5 to S7, based on the amount of the slewing operation and slew speed, the controller 28 calculates outlet-side pressure of the hydraulic motor 11 in an assumed circuit lacking in the communication valves 26 and 27 similarly to a conventional circuit and obtains a reduction in back pressure by subtracting a motor outlet-side pressure detected value P1 from the outlet-side pressure calculated value ΔP, determining a regeneration amount (regenerative torque) corresponding to the back pressure reduction and issuing a command thereon to the slewing electric motor 30. In detail, the controller 28 stores, in advance, opening characteristics representing a relationship between slewing operation amount and meter-out opening area of the control valve 13 shown in FIG. 3, and calculates a meter-out opening area "A" based on the opening characteristics and the detected slewing operation amount. In addition, the controller 28 calculates a flow rate (slewing flow rate) Q flowing to the hydraulic motor 11 based on the detected slew speed, and calculates the outlet-side pressure ΔP according to the following equation, using the slewing flow rate Q and the calculated meter-out opening area A (step S5).

$$Q=Cd\cdot A\sqrt{(2\Delta P/\rho)}$$

Cd: flow rate coefficient

ρ: fluid density

Subsequently, the controller 28 obtains a difference between the outlet-side pressure calculated value ΔP and the detected value P1(=ΔP−P1), that is, the reduction in back pressure due to the communication valves 26 and 27, and determines a regeneration amount corresponding to the back pressure reduction (step S6), giving an instruction on the regeneration amount to the slewing electric motor 30 in step S7 and repeating step S1.

In the case of NO in step S3, that is, in the case of no slewing operation and no slew speed, the controller 28, assuming that it is a slewing stopped state, causes the communication valves 26 and 27 to be closed in step S8, and thereafter performs step S9. In the case of NO in step S2, that is, in the case where a slewing operation has been applied but no slew speed has occurred, the controller 28, assuming that there is not an actual slewing operation but a pressing operation or the like, also performs step S9. In other words, the controller 28 repeats step S1 without issuing a regeneration command to the slewing electric motor 30.

Thus causing the outlet-side communication valve of the communication valves 26 and 27 to be opened to return the hydraulic fluid discharged from the hydraulic motor 11 to the tank T while bypassing the control valve 13 during a slewing operation whichever in a slewing drive or deceleration enables back pressure to be reduced, and, furthermore, having the slewing electric motor 30 produce regenerative power corresponding to the back pressure reduction makes it possible to improve regeneration efficiency without increasing pump power in a slewing drive state, in general, allowing an energy-saving effect to be enhanced.

Besides, keeping the outlet-side communication valve open throughout a slewing operation enables pressure fluctuations due to switching of a switching valve such as those that occur according to the technique described in Patent Document 1 to be eliminated, thus allowing favorable operability to be secured.

In addition, the controller 28, calculating the motor outlet-side pressure ΔP in the assumed case of lacking in the communication valves 26 and 27 based on a meter-out opening area A of the control valve 13 determined based on the slewing operation amount and the motor flow rate Q determined based on slew speed and obtaining a reduction in back pressure by subtracting a motor outlet-side pressure detected value P1 from the motor outlet-side pressure calculated value ΔP, can accurately determine the back pressure reduction to perform appropriate regenerative control with no excess or deficiency in regenerative power.

Figure 4:
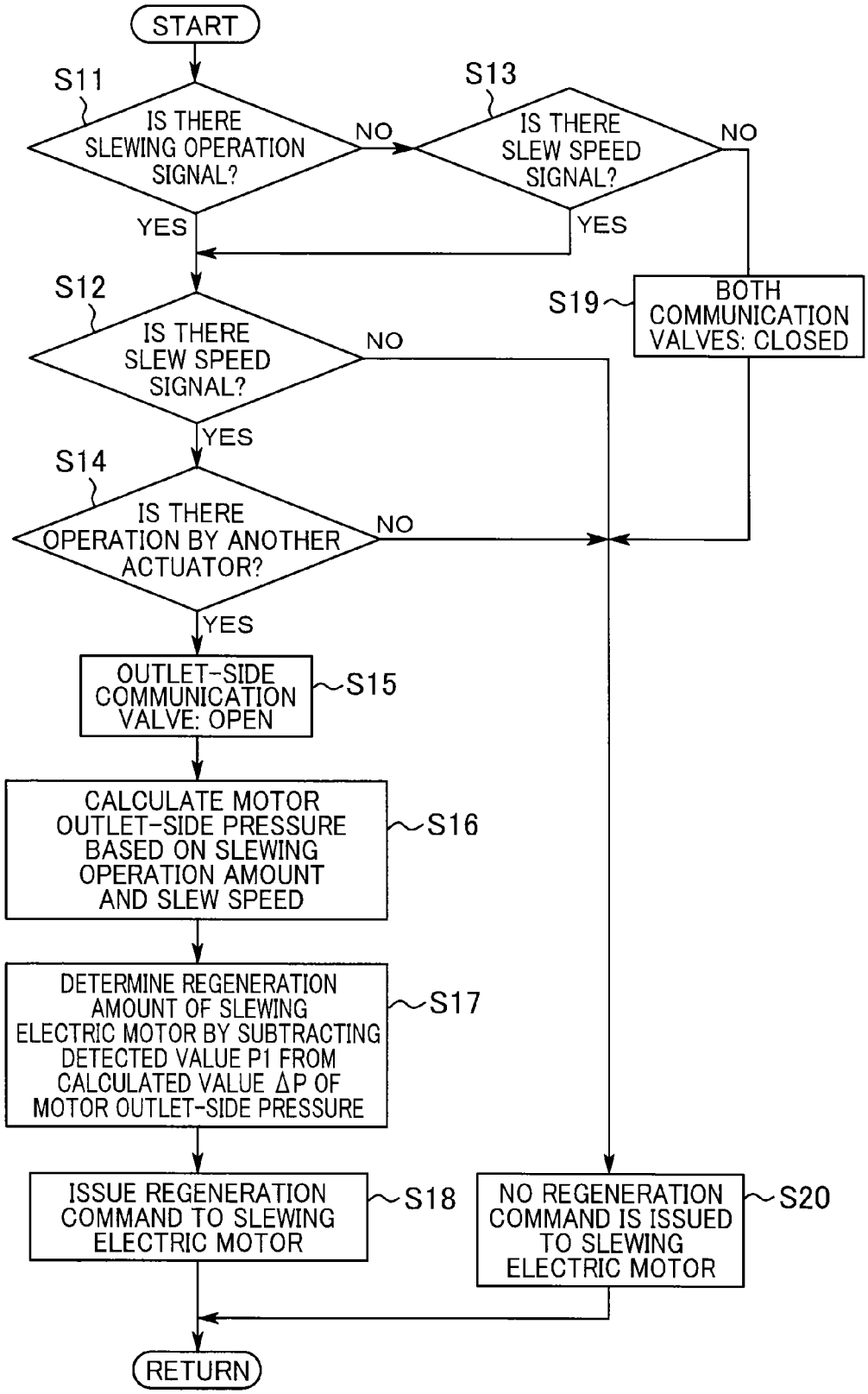
FIG. 4 is a flow chart showing a control operation of a controller according to the second embodiment of the present invention.
Figure 5:
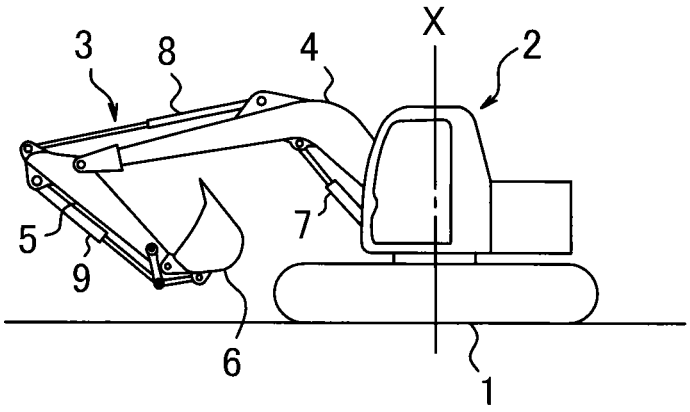
FIG. 5 is a side view showing a general excavator.

Next will be described a second embodiment with reference to FIG. 4.

In an ordinary excavator, a plurality of hydraulic actuators including the slewing hydraulic motor 11 is driven by a single hydraulic pump. In this case, when a slewing operation is singly applied, pump pressure in a slewing drive state originally does not reach a significantly high level and back pressure also remains low; however, if the slewing electric motor 30 is caused to perform a regenerative action in this state, pump pressure rises, which may decline an energy-saving effect as a whole during all slewing operations. On the other hand, when a combined-operation is applied, pump pressure is raised by operation pressure of a hydraulic actuator other than the slewing hydraulic motor 11, which increase both of an advantage of reducing back pressure and an effect of improving regeneration; therefore, the energy-saving effect as a whole is significant.

The second embodiment is designed with consideration of such circumstances. Specifically, this embodiment is premised on common use of the hydraulic pump 10 for a plurality of hydraulic actuators including the slewing hydraulic motor 11. The controller according to the second embodiment, though basically performing control similar to that of the controller 28 according to the first embodiment, make no performance of the regenerative control when a slewing operation is singly operated to operate only the slewing hydraulic motor 11, and performs the regenerative control only when the combined-operation is performed to operate the slewing hydraulic motor 11 and other hydraulic actuators simultaneously.

Details thereof will be described with reference to FIG. 4. Steps S11 to S13 shown in FIG. 4 are equal to respective steps S1 to S3 in FIG. 2 (first embodiment). In the case of YES in step S12, that is, in the case of presence of a slew speed signal, the controller, in step S14, judges a presence or absence of an operation by another actuator or, in other words, a presence or absence of a combined-operation. In the case of YES in step S14, the controller, in steps S15 to S18, similarly to steps S4 to S7 in FIG. 2, performs: causing the outlet-side communication valve to be opened; calculating motor outlet-side pressure, that is, acquiring a calculated value ΔP; determining a regeneration amount of the slewing electric motor 30; and issuing a regeneration command to the slewing electric motor 30. In the case of NO in step S13, that is, in the case of no slewing operation and no slew speed, the controller, assuming that the slewing is being stopped, causes the communication valves 26 and 27 to be closed in step S19, and thereafter performs step S20. In cases of NO in step S12 and step S14, the controller similarly performs step S20 and subsequently repeats S11 without issuing a regeneration command to the slewing electric motor 30.

As described above, performing regenerative control not during an independent slewing operation but only during a combined-operation allows the energy-saving effect to be maximized.

The present invention is not limited to the embodiments described above but includes modes such as those described below.

(1) In the embodiments described above, the outlet sides of the communication valves 26 and 27 are connected to the passage 23 of the hydraulic brake device 20 via the passage 29, that is, the makeup line 24 is used also as a line which connects the outlet sides of the communication valves 26 and 27 to the tank T; however, the outlet sides of the communication valves 26 and 27 may be connected to the tank T by a dedicated tank connecting line.

(2) Although the communication switching device according to the embodiments described above includes communication valves 26 and 27 which are respective first and second communication valves between the pipe-lines 14 and 15 on both sides of the motor and the tank T, each communication valve adapted to be switched between the open position "a" for bringing the motor outlet-side pipe-line into communication with the tank T and the closed position "b" for cutting off the communication, the communication switching device according to the present invention may include a single common communication valve that is shared by the pipe-lines 14 and 15 on both sides, the common communication valve being adapted to be switched among the following positions: a closed position for cutting off the common communication valve off both pipe-lines 14 and 15 from the tank T; a first open position for cutting off the left slewing pipe-line 14 from the tank T and bringing the right slewing pipe-line 15 with the tank T; and a second open position for cutting off the right slewing pipe-line 15 from the tank T and bringing the left slewing pipe-line 15 into communication with tank T.

(3) The slewing-type working machine according to the present invention is not limited to an excavator. For example, the present invention may also be applied to other slewing-type working machines such as a demolition machine or a crusher formed by use of a mother body of an excavator.

As described above, the present invention provides a slewing-type working machine capable of performing a regenerative action not only during slewing deceleration but also during drive for slewing to improve regeneration efficiency of slewing energy and further capable of obviating large pressure fluctuations to improve operability. The slewing-type working machine provided by the present invention includes: a base carrier; an upper slewing body mounted on the base carrier so as to be capable of being slewed; a hydraulic motor which includes first and second ports and receives supply of hydraulic fluid through one of the first and second ports and discharges the hydraulic fluid through the other one of the first and second ports, thereby driving the upper slewing body to slew it; a hydraulic pump which discharges the hydraulic fluid to be supplied to the hydraulic motor; a slewing electric motor which is rotationally driven by the hydraulic motor; an electricity storage device storing regenerative power by the slewing electric motor; a slewing operating device including an operating member to which an operation is applied to input a command for the driving to slew, the slewing operating device being adapted to output an operation signal corresponding to the operation applied to the operating member; a control valve which is operated based on the operation signal of the slewing operating device so as to control supply of hydraulic fluid to the hydraulic motor and control discharge of hydraulic fluid from the hydraulic motor; a first pipe-line connecting the first port of the hydraulic motor to the control valve; a second pipe-line connecting the second port of the hydraulic motor to the control valve; a communication switching device switchable between a communication state of bringing a pipe-line on an outlet side of the hydraulic motor of the first and second pipe-lines into communication with a tank or a pipe-line on an inlet side of the hydraulic motor of the first and second pipe-lines while bypassing the control valve and a communication cutoff state of cutting off the communication; an operation detector which detects the operation applied to the operating member of the slewing operating device; and a controller which controls a regenerative operation of the slewing electric motor and switching of the communication switching device, based on the detection signal from the operation detector. During a slewing operation of the upper slewing body, the controller switches the communication switching device to the communicated state and performs regenerative control by issuing a command to the slewing electric motor on a regenerative amount corresponding to a reduction in back pressure by the communication switching device.

Thus returning hydraulic fluid discharged into the pipe-line on the outlet side of the hydraulic motor during a slewing operation whichever in the slewing drive state or deceleration enables back pressure to be reduced. Furthermore, generating regenerative power corresponding to the back pressure reduction to be produced makes it possible to improve regeneration efficiency without increasing pump power in a slewing drive state. In general, an energy-saving effect can be enhanced. Besides, the communication of the pipe-line on the outlet side of the hydraulic motor with the tank throughout a slewing operation prevents pressure fluctuations due to switching of a switching valve as described in Patent Document 1 from being generated, thus securing favorable operability.

The present invention desirably further includes: a slew speed detector detecting slew speed; and a pressure detector detecting outlet-side pressure of the hydraulic motor, wherein the controller calculates motor outlet-side pressure in an assumed case of lacking in the communication switching device, based on a meter-out opening area of the control valve which is determined based on an amount of the operation applied to the operating member and a motor flow rate of the hydraulic motor which is determined based on slew speed, and obtains a reduction in back pressure by subtracting a motor outlet-side pressure detected value from the calculated value of the motor outlet-side pressure. The controller can accurately determine back pressure reduction and perform appropriate regenerative control without excess or deficiency of regenerative power.

In the present invention, the hydraulic pump may be in common use for a plurality of hydraulic actuators including a slewing hydraulic motor. In this case, the controller is preferably adapted to make no performance of the regenerative control during an independent slewing operation to operate only the slewing hydraulic motor and perform the regenerative control only during a combined-operation to simultaneously operate the slewing hydraulic motor and other hydraulic actuators. Thus performing regenerative control only during a combined-operation enables an energy-saving effect to be further enhanced. In the case of common use of the hydraulic pump for a plurality of hydraulic actuators including the slewing hydraulic motor as described above, pump pressure, during an independent slewing operation, originally does not reach a significantly high level and back pressure remains low, but if a regenerative action is performed in this state, pump pressure will be raised, which would generate a possibility of declining a total energy-saving effect through all slewing operations; on contrary, during a combined-operation, pump pressure is raised by operating pressure of other hydraulic actuators and both of an advantage of reducing back pressure and an effect of improving regeneration efficiency are increased, thus allowing the energy-saving effect as a whole to be enhanced.

The communication switching device is preferably provided between the first and second pipe-lines and the tank, being switchable among a state of cutting off both of the pipe-lines from the tank, a state of bringing the first pipe-line into communication with the tank and cutting off the second pipe-line from the tank, and a state of bringing the second pipe-line into communication with the tank and cutting off the first pipe-line from the tank. In this case, it is preferable that the controller operates the communication switching device during a slewing operation of the upper slewing body so as to bring a pipe-line corresponding to an outlet-side pipe-line that is a pipe-line on an outlet side of the hydraulic motor of the first and second pipe-lines into communication with a tank and cut off the other pipe-line from the tank.

More specifically, it is preferable, for example, that the communication switching device includes: a first communication valve provided between the first pipe-line and the tank and adapted to be switched between an open position for bringing the first pipe-line into communication with the tank and a closed position for cutting off the first pipe-line from the tank; and a second communication valve provided between the second pipe-line and the tank and adapted to be switched between an open position for bringing the second pipe-line into communication with the tank and a closed position for cutting off the second pipe-line from the tank. In this case, it is favorable that the controller is adapted to, during a slewing operation of the upper slewing body, set the communication valve connected to the outlet-side pipe-line of the hydraulic motor, of the first and second communication valves, to an open position and set the other communication valve of the first and second communication valves to a closed position.

The invention claimed is:

1. A slewing-type working machine comprising:

a base carrier;

an upper slewing body mounted on the base carrier so as to be capable of being slewed;

a hydraulic motor which includes first and second ports and receives supply of hydraulic fluid through one of the ports and discharges the hydraulic fluid through the other one of the ports, thereby driving the upper slewing body to slew the upper slewing body;

a hydraulic pump which discharges the hydraulic fluid to be supplied to the hydraulic motor;

a slewing electric motor capable of being rotationally driven by the hydraulic motor to perform a regenerative operation;

an electricity storage device which stores regenerative power of the slewing electric motor;

a slewing operating device including an operating member to which an operation is applied to input a command for the drive to slew, the slewing operation device being adapted to output an operation signal corresponding to the operation applied to the operating member;

a control valve which is operated based on the operation signal of the slewing operating device so as to control supply of hydraulic fluid to the hydraulic motor and control discharge of hydraulic fluid from the hydraulic motor;

a first pipe-line connecting the first port of the hydraulic motor to the control valve;

a second pipe-line connecting the second port of the hydraulic motor to the control valve;

a communication switching device switchable between a communicated state of bringing a pipe-line on an outlet side of the hydraulic motor of the first and second pipe-lines into communication with a tank or a pipe-line on an inlet side of the hydraulic motor of the first and second pipe-lines while bypassing the control valve and a communication-cutoff state for cutting off the communication;

an operation detector which detects the operation applied to the operating member of the slewing operating device; and a controller which controls a regenerative operation of the slewing electric motor and switching of the communication switching device based on the detection signal from the operation detector, wherein the controller, during a slewing operation of the upper slewing body, switches the communication switching device to the communicated state and performs regenerative control by issuing a command to the slewing electric motor for a regenerative amount based on a reduction in the back pressure by the communication switching device, the reduction in the back pressure by the communication switching device being a difference between a motor outlet-side pressure in an assumed case of absence of the communication switching device and an actual outlet-side pressure of the hydraulic motor reduced by switching the communication switching device to the communication state.

2. The slewing-type working machine according to claim 1, further comprising: a slew speed detector which detects slew speed; and a pressure detector which detects an outlet-side pressure of the hydraulic motor, the controller adapted to calculate motor outlet-side pressure in the assumed case of absence of the communication switching device, based on a meter-out opening area of the control valve determined based on an amount of the operation applied to the operating member and a motor flow rate of the hydraulic motor determined based on the slew speed, and obtains the reduction in back pressure by subtracting a motor outlet-side pressure detected value from the calculated value of the motor outlet-side pressure.

3. The slewing-type working machine according to claim 1, wherein the hydraulic pump is in common use for a plurality of hydraulic actuators including the hydraulic motor, and the controller is adapted to make no performance of the regenerative control during an independent slewing operation to operate only the hydraulic motor and perform the regenerative control only during a combined-operation to simultaneously operate the hydraulic motor and other hydraulic actuators.

4. The slewing-type working machine according to claim 1, wherein the communication switching device is provided between the first and second pipe-lines and the tank, being switchable among a state of cutting off both of the first and second pipe-lines from the tank, a state of bringing the first pipe-line into communication with the tank and cutting off the second pipe-line from the tank, and a state of bringing the second pipe-line into communication with the tank and cutting off the first pipe-line from the tank, and the controller is adapted to operate the communication switching device, during the slewing operation of the upper slewing body, so as to bring a pipe-line corresponding to an outlet-side pipe-line that is a pipe-line on an outlet side of the hydraulic motor, of the first and second pipe-lines, into communication with a tank and cut off the other pipe-line of the first and second pipe-lines from the tank.

5. The slewing-type working machine according to claim 4, wherein the communication switching device includes: a first communication valve provided between the first pipe-line and the tank and adapted to be switched between an open position for bringing the first pipe-line into communication with the tank and a closed position for cutting off the first pipe-line from the tank; and a second communication valve provided between the second pipe-line and the tank and adapted to be switched between an open position for bringing the second pipe-line into communication with the tank and a closed position for cutting off the second pipe-line from the tank, and wherein the controller is adapted to, during the slewing operation of the upper slewing body, set the communication valve connected to the outlet-side pipe-line of the hydraulic motor, of the first and second communication valves, to the open position and sets the other communication valve of the first and second communication valves to the closed position.

* * * * *